US006719530B2

(12) United States Patent
Chow

(10) Patent No.: US 6,719,530 B2
(45) Date of Patent: Apr. 13, 2004

(54) FAN INCORPORATING NON-UNIFORM BLADES

(75) Inventor: Min Chan John Chow, Saratoga, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/115,486

(22) Filed: Apr. 2, 2002

(65) Prior Publication Data

US 2003/0108427 A1 Jun. 12, 2003

(30) Foreign Application Priority Data

Dec. 12, 2001 (TW) ..... 90221696 U

(51) Int. Cl.[7] ..... F04D 29/38
(52) U.S. Cl. ..... 416/203
(58) Field of Search ..... 416/203; 415/175

(56) References Cited

U.S. PATENT DOCUMENTS 2,098,640 A * 11/1937 Cary ..... 416/203
2,222,444 A * 11/1940 Schmidt et al. ..... 416/203
4,930,984 A * 6/1990 Kesel et al. ..... 416/203
6,139,275 A * 10/2000 Noda et al. ..... 416/203
6,488,472 B1 * 12/2002 Miyazawa ..... 416/144

FOREIGN PATENT DOCUMENTS

JP 402061398 A * 3/1990 ..... F04D/29/38

* cited by examiner

*Primary Examiner*—Ninh H. Nguyen
(74) *Attorney, Agent, or Firm*—Wei Te Chung

(57) ABSTRACT

A fan (2) includes a central hub (22), and a plurality of spaced and substantially sector-shaped blades (24) radially extending from the central hub. The blades surround the central hub. Shapes of the blades are similar. Sizes of the blades are all different from one another. Spacings between any two adjacent blades are all different from one another. The blades can therefore be configured such that a natural frequency of the blades is outside a range of a working frequency of a corresponding heat dissipation assembly which is used to dissipate heat from a corresponding electronic device. Resonance of the blades can therefore be completely avoided. Noise and vibration of the blades when the fan is operated can therefore be minimized.

2 Claims, 2 Drawing Sheets

FAN INCORPORATING NON-UNIFORM BLADES

BACKGROUND OF THE INVENTION

1. Field of the Invention

The present invention relates to rotary fans, and particularly to rotary fans incorporating blades of various sizes and locations.

2. Prior Art

Electronic devices such as central processing units (CPUs) frequently generate large amounts of heat during normal operation, which can destabilize operation and cause damage. Oftentimes, a heat dissipation assembly is used to dissipate heat from the electronic device. The heat dissipation assembly frequently comprises a fan facilitating heat dissipation from the electronic device.

Referring to FIG. 4, a conventional fan 1 comprises a central hub 2 and a plurality of spaced blades 3 radially extending from the hub 2. The blades 3 are all isometric and evenly spaced apart. Sizes of the blades 3 depend on a required power of the fan 1. A natural frequency of such blades 3 is therefore constant. Unfortunately, the natural frequency of such blades 3 is sometimes close to or within a range of the working frequency of a corresponding heat dissipation assembly. Resonance is produced, which results in extra noise and vibration.

The resonance problem can be overcome by using heavier blade material to increase the natural frequency of the blades beyond the range of the working frequency of the heat dissipation assembly. This expedient, however, increases a weight of the fan and increases costs.

It is strongly desired to provide an improved fan which overcomes the above problems.

SUMMARY OF THE INVENTION

Accordingly, an object of the present invention is to provide a fan which has non-uniform blades that render a natural frequency of the blades beyond a range of a working frequency of a corresponding heat dissipation assembly.

To achieve the above-mentioned object, a fan in accordance with a preferred embodiment of the present invention comprises a central hub, and a plurality of spaced and substantially sector-shaped blades radially extending from the central hub. The blades surround the central hub. Shapes of the blades are similar. Sizes of the blades are all different from one another. Spacings between any two adjacent blades are all different from one another. The blades can therefore be configured such that a natural frequency of the blades is outside a range of a working frequency of a corresponding heat dissipation assembly which is used to dissipate heat from a corresponding electronic device. Resonance of the blades can therefore be completely avoided. Noise and vibration of the blades when the fan is operated can therefore be minimized.

Other objects, advantages and novel features of the present invention will be drawn from the following detailed description of preferred embodiments of the present invention with attached drawings, in which:

DESCRIPTION OF THE PREFERRED EMBODIMENTS

Figure 1:
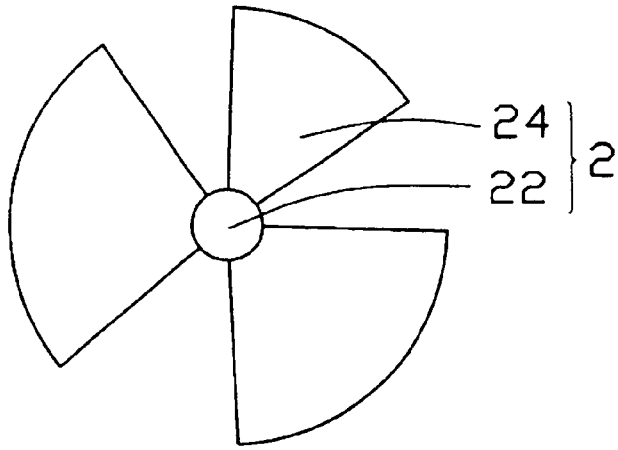
FIG. 1 is a top plan view of a fan in accordance with a preferred embodiment of the present invention.

Referring to the attached drawings, FIG. 1 shows a fan 2 in accordance with a preferred embodiment of the present invention. The fan comprises a central hub 22, and a plurality of spaced and substantially sector-shaped blades 24 radially extending from the central hub 22. The blades 24 surround the central hub 22. Shapes of the blades 24 are all similar to one another. Sizes of the blades 24 are all different from one another. Spacings between any two adjacent blades 24 are all different from one another.

Figure 2:
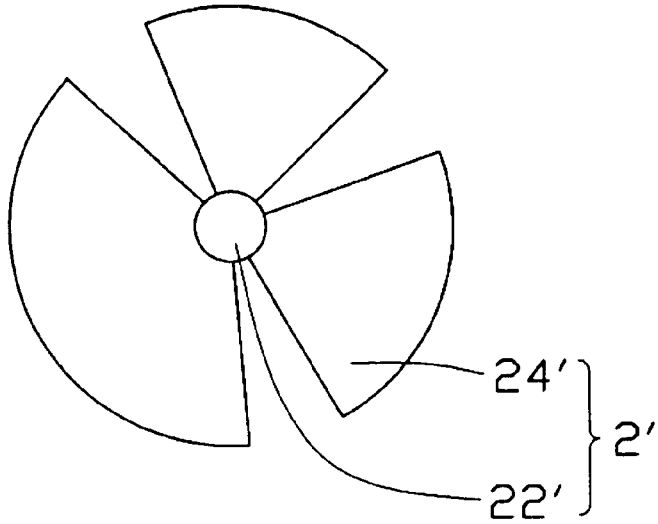
FIG. 2 is a top plan view of a fan in accordance with an alternative embodiment of the present invention.

FIG. 2 shows a fan 2' in accordance with an alternative embodiment of the present invention. The fan 2' comprises a central hub 22', and a plurality of spaced and substantially sector-shaped blades 24' radially extending from the central hub 22'. The blades 24' surround the central hub 22'. Shapes of the blades 24' are all similar to one another. Sizes of the blades 24' are all different from one another. Spacings between any two adjacent blades 24' are all the same as one another.

Figure 3:
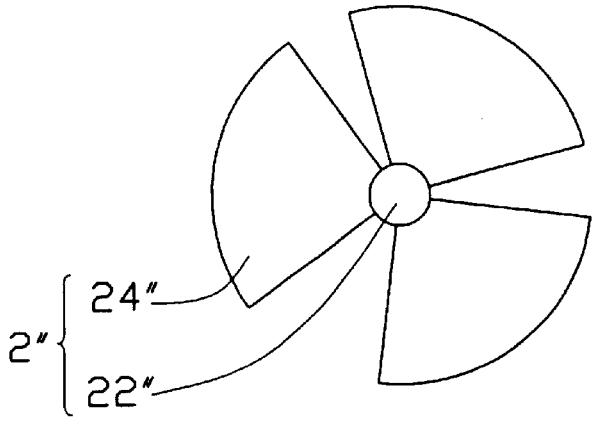
FIG. 3 is a top plan view of a fan in accordance with a further alternative embodiment of the present invention.
Figure 4:
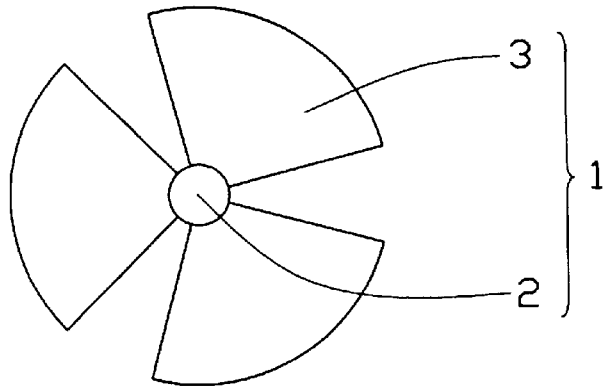
FIG. 4 (PRIOR ART)
FIG. 4 is a top plan view of a conventional fan.

FIG. 3 shows a fan 2" in accordance with a further alternative embodiment of the present invention. The fan 2" comprises a central hub 22", and a plurality of spaced and substantially sector-shaped blades 24" radially extending from the central hub 22". The blades 24" surround the central hub 22". The blades 24" are all the same as one another. Spacings between any two adjacent blades 24" are all different from one another.

In the present invention, sizes of and/or spacings between the blades 24, 24', 24" can be configured such that a natural frequency of the blades 24, 24', 24" is outside a range of a working frequency of a corresponding heat dissipation assembly which is used to dissipate heat from a corresponding electronic device. Resonance of the blades 24, 24', 24" can therefore be completely avoided. Noise and vibration of the blades 24, 24', 24" when the fans 2, 2', 2" are operated can therefore be minimized. Understandably, the differences among the blades or the intervals should preferably be carefully arranged for not resulting in significant unstable or unbalanced rotation jeopardizing reliability of the fan.

It is understood that the invention may be embodied in other forms without departing from the spirit thereof. Thus, the present example and embodiments are to be considered in all respects as illustrative and not restrictive, and the invention is not to be limited to the details given herein.

What is claimed is:

1. A fan for use in a heat dissipation assembly, comprising:

a central hub; and a plurality of spaced blades radially extending from the central hub, wherein the blades are arranged to be on-uniform thereby rendering a natural frequency of the blades outside a range of a working frequency of the heat dissipation assembly, and wherein the blades and spacings between every adjacent two blades together form a circle and share a same circle center, each of the blades and spacings is a sector of the circle, at least two included angles of the sectors of said blades are different from one another, and at least two included angles of the sectors of said spacings are different from one another.

2. A fan for use with a heat dissipation assembly comprising:

a hub; and a plurality of blades radially extending from said hub; wherein said blades generally define a common radial dimension, the blades and intervals between any two adjacent blades each are sector-shaped which together define a circle, at least two included angles of respective blades are different from each other, while included angles of the intervals are the same with one another.

* * * * *